United States Patent [19]

Krueger

[11] 4,409,795

[45] Oct. 18, 1983

[54] DEMAND DEFROST SYSTEM

[75] Inventor: Henry R. Krueger, Yorba Linda, Calif.

[73] Assignee: Russell Coil Company, Brea, Calif.

[21] Appl. No.: 271,288

[22] Filed: Jun. 8, 1981

Related U.S. Application Data

[63] Continuation-in-part of Ser. No. 250,856, Apr. 3, 1981, abandoned, which is a continuation of Ser. No. 53,689, Jul. 2, 1979, abandoned.

[51] Int. Cl.[3] ..... F25D 21/02

[52] U.S. Cl. ..... 62/140; 62/156; 250/222.2

[58] Field of Search ..... 62/156, 140, 126; 340/580; 165/11; 250/222 X

[56] References Cited

U.S. PATENT DOCUMENTS 2,377,926 6/1945 Dreier ..... 62/140 X 3,120,108 2/1964 Pansing ..... 62/140 X 3,961,495 6/1976 Beauvent et al. ..... 62/140

*Primary Examiner*—William E. Wayner

*Attorney, Agent, or Firm*—Dressler, Godlsmith, Shore, Sutker & Milnamow Ltd.

[57] ABSTRACT

A demand defrost system is provided for detecting the existence of frost build-up on the surface of the heat exchanger of a cooling system. A light beam is directed through the heat exchanger such that frost build-up blocks the path of the light from reaching a photocell. When the light received by the photocell falls below a selected value, a control signal is produced which discontinues cooling operation of the cooling system and initiates defrost heaters which heat the cooling coils and remove the frost build-up thereon. A temperature sensing switch is also provided which reinitiates the cooling cycle after a temperature indicates that frost has been removed from the cooling coils.

34 Claims, 4 Drawing Figures

DEMAND DEFROST SYSTEM

BACKGROUND OF THE INVENTION

This is a continuation-in-part application of Ser. No. 250,856, filed Apr. 3, 1981, now abandoned, which is a continuation of application Ser. No. 53,689, filed July 2, 1979, now abandoned.

TECHNICAL FIELD

This invention relates to demand defrost systems for use with cooling systems.

BACKGROUND ART

In refrigeration systems, frost tends to build up on the evaporator or cooling coils due to condensation of the moisture in the air cooled by the coils. This frost build-up reduces the efficiency of the heat transfer, and when substantial, creates a significant resistance to air flow across the cooling coils. It is necessary, therefore, to defrost the cooling coil surfaces periodically so that it can be restored to its original frost-free condition and operate in its normally efficient manner.

Changes in ambient conditions, such as differences in the moisture content of the air, varying numbers of times doors to the cooling or refrigeration compartments are opened, variance in the amount of humidity in the air on given days, and the diverse applications of cooling systems in different environments results in significant variations in the amount of frost as a function of time, both from system to system and for any one system subjected to such varying conditions.

Prior art devices have incorporated time controls which arbitrarily fix the frequency at which defrosting occurs. These time control devices do not take into account the actual amount of frost that is present on the cooling coils. Since such systems are preset to initiate a defrost cycle at fixed time intervals without regard to the actual need for defrost operations, defrost cycles may commence before there is a real need for defrosting, or well after a time when a defrost cycle should have been started. In either case, the result is a significant waste of electrical energy.

When the defrost cycle does not occur as frequently as needed, the efficiency of the cooling system is greatly reduced and more energy is expended running the compressor more than is needed. When the defrost system operates more frequently than is needed, energy is also wasted due to the excessive energy needed to power the heaters which heat up the cooling coil surfaces, and to recool the system after defrosting is complete. Keeping a time control device in adjustment for the specific application and variable weather and humidity conditions would require continual maintenance and adjustment and is not really a practical alternative.

Further, one device which presently attempts to control defrosting by demand requires installation of a separate sensing unit mounted on the cooling coils. Such units sense only the frost build-up on themselves, and thus are designed to simulate the frost build-up on the cooling coil. Such an indirect method has not proved to be an accurate way to detect the actual frost that builds up on the cooling coil, not only because it attempts to detect frost indirectly, but also because it is restricted to sense frost only at a single point.

Another approach for detecting frost contemplated a fan motor sensing circuit to sense variations in the fan speed as a result of air flow resistance due to the frost build-up. Attempts to construct this type of system have met with little success.

Air temperature sensing devices to detect the need for defrosting have also been tried. Such a device would clearly only detect the temperature in the vicinity of the heat exchanger and not the amount of frost actually accumulated on the heat exchanger. This indirect method of detecting frost build-up has been generally unreliable or at least too variable to serve its intended purpose.

BRIEF SUMMARY OF THE INVENTION

In accordance with the present invention, a demand defrost system for use with cooling systems of the type having a compressor and heat exchanger includes a probing light source positioned to direct a light beam through the heat exchanger. A light responsive device, such as a photocell, is positioned to receive the light after it passes through the heat exchanger such that frost built up on the heat exchanger will obstruct the light path and will reduce the amount of light impinging on the photocell. When the light received by the photocell drops below a determined amount, a control signal is produced which discontinues operation of the cooling cycle and initiates a defrost cycle.

The demand defrost system of the present invention detects frost build-up directly on the cooling coil itself and activates a defrost cycle only when the need for defrost exists. Such a system does not require the continuous monitoring or adjustment required of prior defrost systems. The system of the instant invention also senses frost build-up at several locations on the heat exchanger surfaces. These features overcome the deficiencies of the prior art which only indirectly sense frost build-up on the coils and which only sense frost build-up at a single location near the cooling coils.

Substantial energy savings will result from the use of the novel invention and after installed, the invention will require a minimal monitoring and or adjustment.

Numerous other advantages and features of the present invention will become readily apparent from the following detailed description of the invention and embodiments thereof, from the claims and from the accompanying drawings in which like numerals are employed to designate like parts throughout the same.

DETAILED DESCRIPTION OF THE PREFERRED EMBODIMENT

Figure 1:
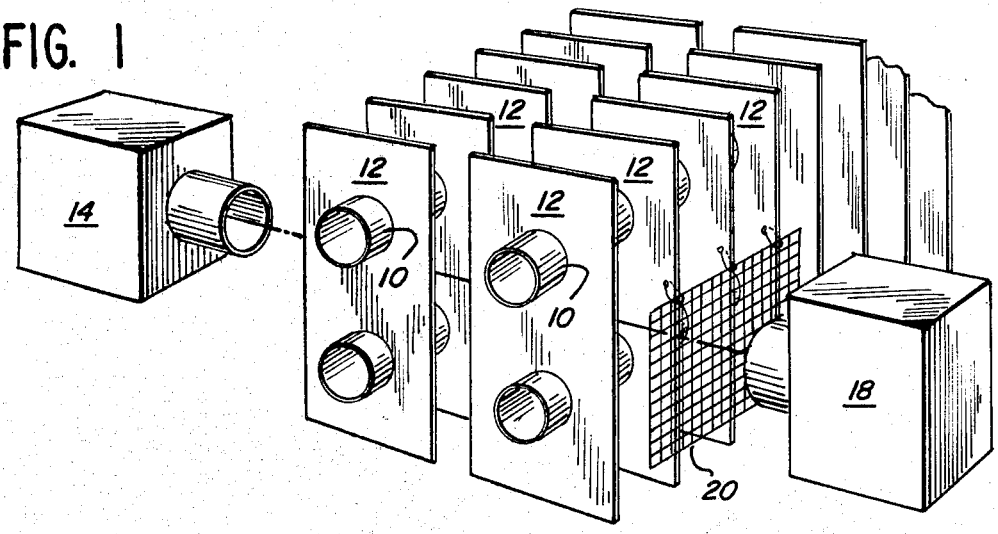
FIG. 1 is a perspective view of finned coiling coils showing a light source generating a light beam which is passed through the coils and received by an optical sensing device.
Figure 1:
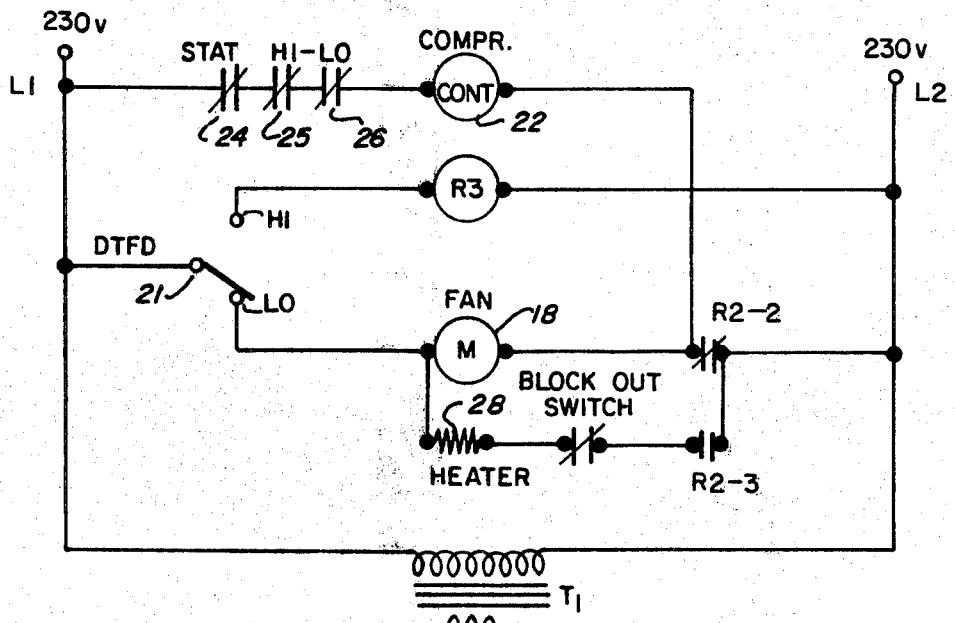

While this invention is susceptible of embodiment in many different forms, there are shown in the drawings and will herein be described in detail preferred embodiments of the invention. It should be understood, however, that the present disclosure is to be considered as an exemplification of the principles of the invention and is not intended to limit the invention to the embodiments illustrated.

In the following description, two digit numerals are used to refer to the embodiment illustrated in FIG. 2, and corresponding three digit numerals are used to refer to the embodiments illustrated in FIGS. 3 and 4. The same last two digits in each numeral designate similar or functionally analogous elements in the various embodiments.

Referring now to the drawing, FIG. 1 shows a series of cooling coils 10 with fins 12 attached thereto. Not shown in FIG. 1 is a fan which blows the cool air through and over the coils 10 and fins 12 into the refrigeration or freezer area. The coils 10 constitute the evaporator portion of the refrigeration system and contain cooling fluid and are connected to a compressor as is well known. Techniques for producing the coils and fins are well known in the art and do not constitute, as such, any part of the present invention.

Frost or other condensation normally builds up on the surfaces of the cooling coils 10 and the fins 12 after a period of time. The result is inefficient heat transfer and resistance to the air flow through the coils and fins. After a period of time the air flow is severely restricted and the cooling system no longer operates efficiently and it is therefore necessary to defrost the surfaces of coils 10 and fins 12 so that they can be restored to their original frost-free condition.

To accomplish this defrosting with a minimum of energy expenditure, the invention initiates a defrosting cycle only when a predetermined amount of frost has built up on the coils 10 and fins 12. In this way the defrost cycle occurs only when necessary, and energy expenditure is minimized.

Light source 14 emits a light beam through cooling coils 10 and fins 12 and is received by photo electric cell 16 in housing 18. The light beam preferably has about a 1–2 to 2 inch diameter and the fins 12 typically are constructed with spacing equal to about 4 to 8 per inch. Thus, an acceptable amount of frost build-up can occur before the light beam is obstructed from reaching photo electric cell 16. The beam width of this light beam can be varied depending on the spacing between the fins or coils, without altering the configuration of the fins or coils. The sensitivity of this defrost system can also be adjusted by placing a metal woven mesh-type screen 20 at one or more locations in the cooling evaporator coil area transverse to the path of the light beam. This wire mesh screen frosts up before the coils have excessively frosted to inhibit the optical signal from reaching the photocell 16. Thus, the defrost system initiates the defrost cycle before frost on the coils and finds have built up to excessive levels. This screen 20 is especially useful as the distance between the fins is increased. By placing one or more screen at any one of several locations, an accurate and reliable indication of defrosting demands can be obtained for different cooling coils and fin arrangements.

Figure 2:
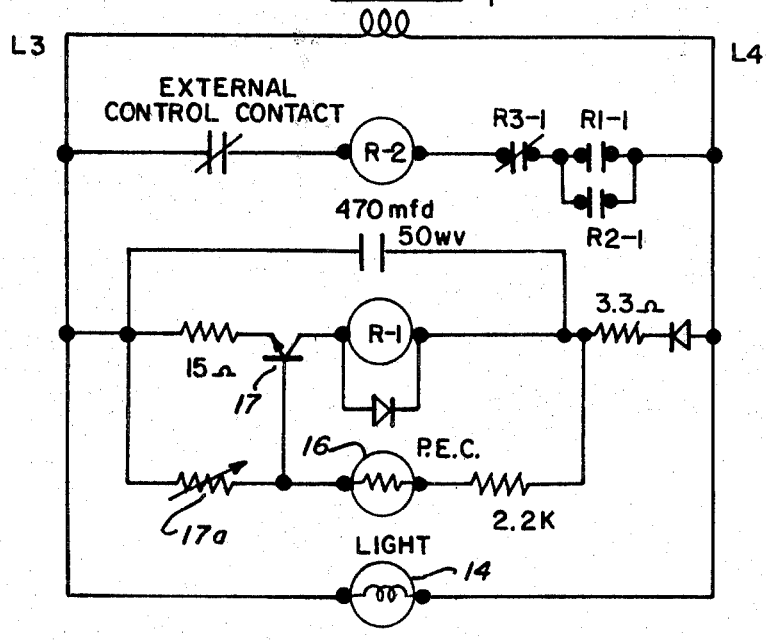
FIG. 2 is an electrical schematic showing a first embodiment of a circuit for the demand defrost system.

Turning now to the circuitry, a potential of 230 volts is applied across lines L1 and L2 in the upper half of FIG. 2. Transformer T1 steps this potential down to create a voltage potential of 12 volts across lines L3 and L4. The potential across L1 and L2 could alternatively be 115 volts. The voltage potential across L3 and L4 powers light source 14 which transmits light to photo electric cell 16. The photo electric cell 16 conducts as long as at least a predetermined amount of light is received from light source 14. When photo electric cell 16 is conducting, indicating that an excess amount of frost has not built up on the fins 12, switching transistor 17 is not conducting and no current flows through sensing relay R1. R1 could be any other switching control means, as can be R2 and R3 described below.

When the amount of light received by photo electric cell 16 decreases below a selected amount because frost build-up on the fins 12 or the screen 20 blocks the light path, the photo electric cell 16 no longer conducts, switching transistor 17 turns on and current flows through the transistor's collector-emitter junction. The sensitivity of switching transistor 70 in response to photo-electric cell 16 can be adjusted by varying the resistance of resistor 17*a*.

When the transistor 17 conducts, the light sensing relay R1 conducts and produces a control signal which causes normally open contacts R1-1 to close. This completes a circuit through defrost control relay R2, if the external control contact is closed as normal, and through normally closed contacts R3-1 of heater shut-off relay R3. When defrost control relay R2 is energized, normally open holding contacts R2-1 close thereby locking defrost control relay R2 into the circuit independently of whether or not contacts R1-1 remain closed.

Therefore once the light sensing relay R1 is activated and contacts R1-1 close causing defrost relay R2 to conduct, R2 continues to conduct independently of whether a control signal is generated by the conduction of transistor 17, and will continue to conduct until the normally closed contacts R3-1 are opened by activation of heater shut-off relay R3 indicating that the defrost cycle is complete, the operation of which will be discussed below.

During the normal operation of the compressor and fan motor 18, the defrost termination fan delay (DTFD) temperature sensing switch 21 is in the low temperature position indicating a relatively cold temperature around the cooling condensor coil and fin area. The DTFD sensing switch 21 is a SPDT switch sensitive to temperature in the evaporator cooling coil area. In its normal low temperature position, DTFD switch completes a circuit through fan motor 18 and the normally closed contacts R2-2 so fan motor 18 continually blows air through the cooling coil and fin area into the refrigeration or freezer area as long as normally closed contacts R2-2 remain closed.

The compressor controller 22 also continues to operate if the normally closed contacts R2-2 remain closed, if thermostat contacts 24 are closed indicating a demand to cool, and if high pressure safety switch 25 and low pressure safety switch 26 remain closed indicating a safe condition for the compressor to continue operating. These switches 24, 25 and 26 are common in refrigeration systems and well known to those skilled in the art.

Once the defrost control relay R2 is activated in response to the control signal as described above, the normally closed contact R2-2 in series with the compressor controller 22 and the fan 18 open to de-energize the compressor controller 22 and fan motor 18. At this time normally open contacts R2-3 close to complete a circuit through the DTFD switch 21 which is still in the low temperature position, to energize the heater 28 and initiate the defrost cycle. The fan 18 is de-energized to prevent liquid from being blown into the refrigeration area, and to improve coil heating during the defrost cycle.

The heater 28 continues to operate until DTFD switch 21 assumes its high temperature position, which occurs when the temperature around the cooling coils 10 and fins 12 reaches a temperature indicating that the defrost cycle is complete. When the DTFD switch 21 assumes its high temperature position indicating that the defrost cycle should be terminated, heater shut-off relay R3 is energized. When heater shut-off relay R3 is energized, its normally closed contacts R3-1 are opened to de-energize defrost control relay R2. As a result, contacts R2-3 return to their normally open position to de-energize heater 28, contacts R2-2 return to their normally closed position to energize the compressor controller 22 and to enable fan 18, and contacts R2-1 return to their normally open position to preclude defrost control relay R2 from being energized when contacts R3-1 close.

The compressor controller 22 starts the compressor to circulate coolant through the coils 10. Since the DTFD switch 21 is still in the high temperature position, fan motor 18 is not yet energized. This prevents moisture from being blown off the cooling coils 10 and fins 12 into the refrigeration area.

Before the temperature sensed by the DTFD switch 21 drops to a selected value and indicates a cold temperature condition, the moisture in the coil area either evaporates, falls to a drain pan or freezes. When the DTFD switch 21 returns to its low temperature position, a circuit is completed through DTFD switch 21, fan motor 18 and normally closed contacts R2-2, and the whole refrigeration system returns to operate in the normal manner. This normal operation continues until frost builds up, the light from light source 14 is obstructed, and the defrost cycle again initiates.

Figure 3:
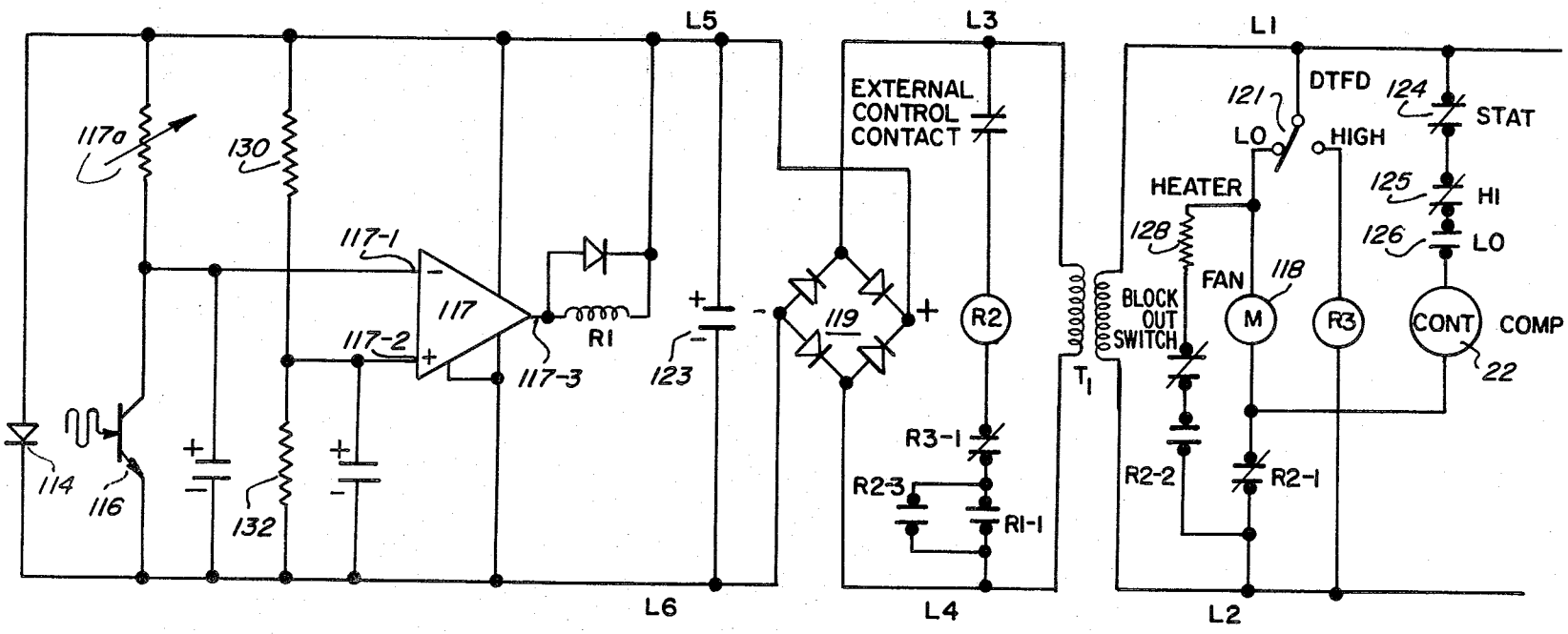
FIG. 3 is an electrical schematic showing a second solid state embodiment of the demand defrost system.

FIG. 3 illustrates a second embodiment circuit employing a voltage comparator to provide a control signal to trigger the light sensing relay R1. A light emitting device 114 directs light towards the photoelectric cell 116. Light emitting device 114 could be a semiconductor such as a photoemissive diode and photoelectric cell 116 could be a semiconductor such as a phototransistor. Adjustment of variable resistor 117*a* changes the level at which light received by the photoelectric cell 116 will affect the operation of the voltage comparator 117 to produce the control signal.

A full wave rectifying bridge 119 creates a dc voltage potential between L5 and L6. This dc potential is filtered by filter capacitor 123 and supplies operating voltage to voltage comparator 117 which in one embodiment is an LM301 manufactured by National Semiconductor. The voltage comparator compares the voltage of its input terminals and normally has a high output at its output terminal 117-3 when the voltage at input terminal 117-2 is higher than at input terminal 117-1. When the voltage at 117-1 is higher than at 117-2, then the output at output terminal 117-3 drops to a low state. Proper selection of resistors 117*a*, 130 and 132 will result in terminal 117-1 being held at a lower voltage potential than 117-2 when photoelectric cell 116 is conducting. When frost builds up and obstructs light from light source 114 from reaching photoelectric cell 116, photoelectric cell 116 no longer conducts and the voltage potential of 117-1 is greater than 117-2. The voltage comparator 117 output terminal 117-3 drops to a low voltage potential relative to L5. This creates a voltage potential across relay R1 and causes this relay to conduct producing a control signal which causes normally open contacts R1-1 to close. The remainder of the circuit of FIG. 3 operates in a similar fashion to the circuit of FIG. 2 which is described above.

Figure 4:
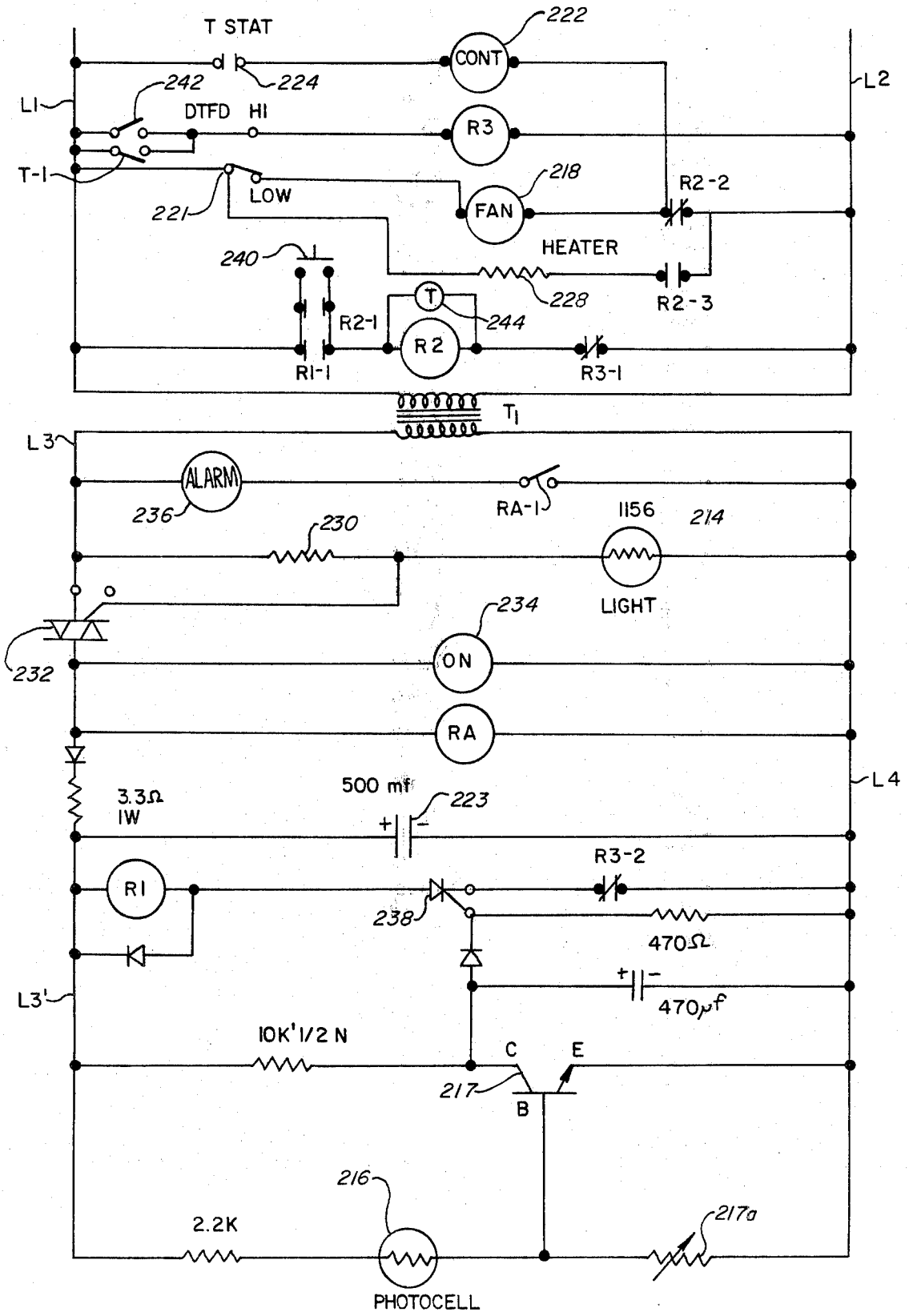
FIG. 4 is an electrical schematic showing a third embodiment of a circuit for the demand defrost system.

The embodiment shown in FIG. 4 is similar to FIG. 2, but incorporates additional operational and fail-safe capabilities. The 230 volt potential is applied across main line L1 and L2 to step down transformer T1 which steps this voltage down to 12 volts across lines L3 and L4.

The light source 214 is connected in series with balancing register 230 across lines L3 and L4. The junction between balancing register 230 and light source 214 is connected to the control terminal of a triac 232 in line L3 to disable the light responsive control circuit in the event the light source 214 fails. As a result, defrosting is not initiated when the light source fails.

When this occurs, the circuit through the balancing register 230 and the light source 214 opens and the signal to the control electrode of the triac 232 terminates. The triac ceases to conduct. This opens the circuit to the circuitry connected between that position of line L3 below the triac, line L3′, and line L4 to preclude energization of relay R1. Since relay R1 is not energized, relay R2 connected in series with normally open contacts R1-1 is not energized, and the defrost cycle is not initiated.

A normally energized pilot light 234 is connected between lines L3′ and L4. If light source 214 fails, pilot light 234 will be extinguished to indicate the failure of the light source. An alarm relay RA is also de-energized to close its normally open contacts RA-1 connected in series with an alarm 236 across lines L3 and L4. The alarm is thereby energized to provide an alert that the light source has failed.

In the circuit of FIG. 4, when frost causes light to the photocell 216 to be interrupted, the transistor 217 conducts. The result is a control signal applied to the control electrode of an SCR 238 connected in series with relay R1 and the normally closed contacts R3-1 of relay R3. When relay R3 is energized, as described above, to terminate the defrost cycle, contacts R3-1 are opened to de-energize relay R1.

In the circuit of FIG. 4, relay R2 is a 220 volt relay connected between lines L1 and L2. Except for that change, the operation of relay R2 is substantially the same as described above with respect to FIG. 2. Thus, when relay R2 is energized, contacts R2.1 close to keep relay R2 energized, contacts R2-2 open and contacts R2-3 close to initiate the defrost cycle. When the cycle is complete, the contact of DTFD switch 221 shifts to the high side to energize relay R3. Contacts R3-1 open to de-energize relay R2 and contacts R3-2 open to de-energize relay R1.

Since automatic initiation of the defrost cycle is disabled when the light source 214 fails, a manual switch 240 is provided in parallel with relay contacts R1-1 and R2-1. Closure of the switch manually energizes relay R2 to initiate operation of the defrost cycle which then operates as described, although it cannot be initiated automatically until the light source 214 becomes operative.

Additional safety is provided by a high temperature limit switch 242 connected in series with relay R3. This normally open switch closes to energize relay R3 and terminate the defrost cycle if temperatures become too high due to failure or switch 221. If desired, a safety timer 244 can be connected across relay R2. This timer would be energized simultaneously with relay R2 when the defrost cycle is initiated. The timer contacts T-1 connected in parallel with limit switch 242 close if the timer T times out, which only occurs on failure of the normal DTFD switch 221 and the limit switch 242.

Relays R1, R2, and R3 can be any other switching control means.

It should be appreciated that other forms of signals can be used as a detection signal in the instant invention, such as infrared signals or ultraviolet signals.

From the foregoing, it will be observed that numerous variations and modifications may be effected without departing from the true spirit and scope of the novel concept of the invention. It is to be understood that no limitation with respect to the specific apparatus illustrated herein is intended or should be inferred. It is, of course, intended to cover by the appended claims all such modifications as fall within the scope of the claims.

What is claimed is:

1. In a cooling system with a heat exchanger having a plurality of fins arranged in generally parallel relationship and having coils containing cooling fluid, for cooling air in the vicinity of the exchanger, a demand defrost system for detecting the existence of frost build-up on the planar surfaces of the heat exchanger fins and for initiating a defrost cycle in response thereto comprising:

means at a first peripheral location of said heat exchanger for generating a detection signal and directing said signal along and through a plurality of portions of said heat exchanger along a direct path which passes through the central portion of the heat exchanger between adjacent parallel fins, said path being oriented in a plane generally parallel to said adjacent parallel fins, said detection signal having a characteristic with varies in direct response to build-up of frost on any one of said portions of the planar surfaces of said adjacent parallel fins of the heat exchanger along said path;

means at the end of said path, and at a second peripheral location of said heat exchanger opposed from said first peripheral location, for sensing said variation in said detection signal characteristic and for producing a control signal in response to said characteristic achieving a selected value;

means responsive to the control signal for discontinuing cooling operation of the cooling system and for initiating a defrost cycle; and means responsive to failure of said detection signal generating means for precluding initiation of said defrost cycle.

2. The demand defrost system of claim 1 wherein said defrost cycle initiating means sustains said defrost cycle independently of subsequent termination of said control signal.

3. The demand defrost system of claim 1 including temperature sensing means actuated in response to a selected temperature condition indicating that defrosting is complete for effecting termination of the defrost cycle.

4. The demand defrost system of claim 3 including defrost cycle termination means for terminating said defrost cycle and initiating the cooling cycle in response to actuation of said temperature sensing means.

5. The demand defrost system of claim 4 in which the cooling system includes air circulation fan means which blows air across the heat exchanger to the cooling area;

said defrost cycle initiating means de-energizing said fan means during the defrost cycle.

6. The demand defrost system of claim 5 wherein said temperature sensing means is deactuated in response to a selected temperature condition indicating that the heat exchanger is substantially free of liquid moisture for energizing said fan means after the cooling cycle has commenced.

7. The demand defrost system of claim 1 in which the detection signal is a light signal directed through the heat exchanger.

8. The demand defrost system of claim 7 in which said sensing means is a light sensitive device producing said control signal in response to a selected reduction in the intensity of light received by the light sensitive device.

9. The demand defrost system of claim 1 including at least one detection signal inhibitor located in the heat exchanger which varies the characteristic of the transmitted detection signal as a function of frost build-up on the inhibitor.

10. In a cooling system with a heat exchanger having a plurality of fins arranged in generally parallel relationship and having coils containing cooling fluid, for cooling air in the vicinity of the exchanger, an air circulation fan for passing air directly over the heat exchanger through the fins into a cooling area and a heater for defrosting the heat exchanger, a demand defrost system for detecting the existence of frost build-up on the planar surfaces of the heat exchanger fins and for energizing the heater to initiate a defrost cycle in response thereto comprising:

means at a first peripheral location of said heat exchanger for generating a light detection signal along a direct path through a plurality of portions of the heat exchanger, said path passing through the central portion of said heat exchanger between adjacent parallel fins, said path also being oriented in a plane generally parallel to said adjacent parallel fins, whereby frost which builds up on any one of said portions of the planar surfaces of said adjacent parallel fins of the heat exchanger blocks the path of the light transmitted therethrough;

means at the end of said path, and at a second peripheral location of said heat exchanger opposed from said peripheral location, for sensing the variation of transmitted light transmitted through the heat exchanger along said path and for producing a control signal in response to the intensity of light received falling below a selected value, said means for sensing the variation of transmitted light intensity being a light sensitive device having a first conductive state in response to the light received exceeding the selected value and having a second conductive state in response to the light received falling below the selected value;

means responsive to the control signal for discontinuing cooling operation of the cooling system and for initiating a defrost cycle;

a switching transistor rendered conductive for effecting energization of first switching control means to produce a control signal in response to the second conductive state of said light sensitive device; and second switching control means energized in response to said control signal for opening a first set of normally closed switching control contacts connected to the air circulation fan motor and the compressor to discontinue cooling operation of the cooling system.

11. In a cooling system with a heat exchanger having a plurality of fins arranged in generally parallel relationship and having coils containing cooling fluid, for cooling air in the vicinity of the exchanger, an air circulation fan for passing air directly over the heat exchanger through the fins into a cooling area and a heater for defrosting the heat exchanger, a demand defrost system for detecting the existence of frost build-up on the planar surfaces of the heat exchanger fins and for energizing the heater to initiate a defrost cycle in response thereto comprising:

means at a first peripheral location of said heat exchanger for generating a light detection signal along a direct path through a plurality of portions of the heat exchanger, said path passing through the central portion of said heat exchanger between adjacent parallel fins, said path also being oriented in a plane generally parallel to said adjacent parallel fins, whereby frost which builds up on any one of said portions of the planar surfaces of said adjacent parallel fins of the heat exchanger blocks the path of the light transmitted therethrough;

means at the end of said path, and at a second peripheral location of said heat exchanger opposed from said peripheral location, for sensing the variation of transmitted light transmitted through the heat exchanger along said path and for producing a control signal in response to the intensity of light received falling below a selected value said means for sensing the variation of transmitted light intensity being a light sensitive device having a first conductive state in response to the light received exceeding the selected value and having a second conductive state in response to the light received falling below the selected value, means responsive to the control signal for discontinuing cooling operation of the cooling system and for initiating a defrost cycle;

a voltage comparator for producing an output signal to energize a first switching control means thereby producing a control signal in response to the second conductive state of said light sensitive device; and second switching control means energized in response to said control signal for opening a first set of normally closed switching control contacts connected to the air circulation fan motor and the compressor to discontinue cooling operation of the cooling system.

12. The demand defrost system of claims 10 or 11 wherein said second switching control means, when energized, closes a second set of normally open switching control contacts connected to the heater to initiate a defrost cycle.

13. The demand defrost system of claim 12 wherein said second switching control means when energized closes a third set of normally open switching control means contacts in series therewith to maintain said second switching control means energized independently of said first switching control means.

14. The demand defrost system of claims 10 or 11 including a temperature sensitive switch actuated in response to a selected temperature condition indicating that defrosting is complete for effecting termination of the defrost cycle.

15. The demand defrost system of claim 18 including third switching control means energized in response to actuation of said temperature sensitive switch for opening a set of third switching control contacts connected in series with said second switching control means to de-energize said second switching control means causing said second set of second switching control contacts to de-energize the defrost heater.

16. The demand defrost system of claim 13 wherein said first set of normally open switching control contacts closes in response to de-energization of said second switching control means to initiate the cooling cycle.

17. The demand defrost system of claim 14 wherein the temperature sensitive switch is deactivated in response to a selected reduced temperature condition indicative that the heat exchanger is substantially free of liquid moisture for completing a circuit to energize the cooling fan.

18. The demand defrost system of claim 10 including at least one wire screen located transverse to the light path and in contact with portions of said heat exchanger which blocks the light when frost builds up on the screen.

19. The demand defrost system of claim 10 wherein the means for generating a light detection signal is an incandescent lightbulb, and wherein the means for sensing the variation of transmitted light includes a photoelectric cell.

20. The demand defrost system of claim 10 wherein the means for generating a light detection signal is a photoemissive photodiode and wherein the means for sensing the variation of transmitted light includes a photosensitive phototransistor.

21. In a cooling system with a heat exchanger containing cooling fluid circulating in cooling coils for cooling air in the vicinity of the exchanger, an air circulation fan for passing air over the heat exchanger into a cooling area and a heater for defrosting the heat exchanger, a demand defrost system for detecting the existence of frost build-up on the surface of the cooling coils and fins attached to the coils and for energizing the heater to initiate a defrost cycle in response to frost build-up comprising:

a light emitting device which is directed to transmit a light detection beam through the cooling coil, whereby frost which builds up on the heat exchanger blocks the path of the light detection beam transmitted therethrough;

a light sensitive device which senses the decrease in transmitted light intensity after the light beam is transmitted through the heat exchanger and which activates first relay means when the light received falls below a selected value;

normally open relay contacts which close to energize second relay means to produce a control signal when said first relay means is energized;

a first set of normally closed relay contacts which open to discontinue cooling operation of the circulation fan and heat exchanger when said second relay means is energized;

a second set of normally open relay contacts which close to energize the heater to defrost the built-up frost when said second relay means is energized;

a third set of normally open relay contacts in series with said second relay means and connected in paralell with said first relay contacts which maintain the second relay means energized independently of said first relay means;

temperature sensitive switch means which senses the temperature in the heat exchanger;

third relay means in series with said temperature sensitive switch means energized when the temperature sensitive switch means actuates in response to a selected temperature condition indicating that defrost is complete; and a fourth set of normally closed relay contacts, in series with said second relay means, which open when said third relay means is energized to de-energize said second relay means to open said second set of normally open relay contacts and de-energize the heater, and to close th first set of normally open relay contacts to initiate the cooling cycle.

22. In a cooling system with a heat exchanger containing cooling fluid for cooling air in the vicinity of the exchanger, an air circulation fan for passing air over the heat exchanger into a cooling area and a heater for defrosting the heat exchanger, a demand defrost system for detecting the existence of frost build-up on the surface of the heat exchanger and for energizing the heater to initiate a defrost cycle in response thereto comprising:

means for generating a light detection signal and for directing said light detection signal through the heat exchanger, whereby frost which builds up on the heat exchanger blocks the path of the light transmitted therethrough;

means for sensing the variation of transmitted light transmitted through the heat exchanger comprising a light sensitive device which assumes a first conductive state in response to the intensity of light received exceeding a selected value and having a second conductive state in response to the intensity of light received falling below the selected value and further including a switching transistor rendered conductive for energizing a first switching control means to produce a control signal in response to the second conductive state of said light sensitive device and further including a second switching control means energized in response to said control signal for opening a first set of normally closed switching control means contacts connected to the air circulation fan motor and the compressor to discontinue cooling operation of the cooling system and for initiating a defrost cycle; and a temperature sensitive switch actuated in response to a selected temperature condition indicating that defrosting is complete for effecting termination of the defrost cycle, including a third switching control means energized in response to actuation of said temperature sensitive switch for opening a set of third switching control means contacts connected in series with said second switching control means to de-energize said second switching control means causing a second set of second switching control means contacts to de-energize the defrost heater.

23. The demand defrost system of claim 18 or 21 wherein said first set of normally open switching control means contacts closes in response to de-energization of said second switching control means to initiate the cooling cycle.

24. In a cooling system with a heat exchanger containing cooling fluid for cooling air in the vicinity of the exchanger, an air circulation fan for passing air over the heat exchanger into a cooling area and a heater for defrosting the heat exchanger, a demand defrost system for detecting the existence of frost build-up on the surface of the heat exchanger and for energizing the heater to initiate a defrost cycle in response thereto comprising:

means for generating a light detection signal along a direct path through a plurality of portions of the heat exchanger, whereby frost which builds up on any one of said portions of the heat exchanger blocks the path of the light transmitted therethrough;

a wire screen located transverse to the light path and in contact with portions of said heat exchanger which blocks the light when frost builds up on the screen;

means at the end of said path for sensing the variation of transmitted light transmitted through the heat exchanger along said path and for producing a control signal in response to the intensity of light received falling below a selected value; and means response to the control signal for discontinuing cooling operation of the cooling system and for initiating a defrost cycle.

25. In a cooling system with a heat exchanger containing cooling fluid for cooling air in the vicinity of the exchanger, an air circulation fan for passing air over the heat exchanger into a cooling area and a heater for defrosting the heat exchanger, a demand defrost system for detecting the existence of frost build-up on the surface of the heat exchanger and for energizing the heater to initiate a defrost cycle in response thereto comprising:

means for generating a light detection signal and for directing said light detection signal through the heat exchanger, whereby frost which builds up on the heat exchanger blocks the path of the light transmitted therethrough;

means for sensing the variation of transmitted light transmitted through the heat exchanger comprising a light sensitive device which assumes a first conductive state in response to the intensity of light received exceeding a selected value and having a second conductive state in response to the intensity of light received falling below the selected value and further including a voltage comparator which produces an output signal to energize a first switching control means thereby producing a control signal in response to the second conductive state of said light sensitive device and further including a second switching control means energized in response to said control signal for opening a first set of normally closed switching control means contacts connected to the air circulation fan motor and the compressor to discontinue cooling operation of the cooling system and for initiating a defrost cycle, a temperature sensitive switch actuated in response to a selected temperature condition indicating that defrosting is complete for effecting termination of the defrost cycle, including a third switching control means energized in response to actuation of said temperature sensitive switch for opening a set of third switching control means contacts connected in series with said second switching control means to de-energize said second switching control means contacts to de-energize the defrost heater.

26. In a cooling system with a heat exchanger having a plurality of fins arranged in generally parallel relationship and having coils containing cooling fluid, for cooling air in the vicinity of the exchanger, a demand defrost system for detecting the existence of frost build-up on the planar surfaces of the heat exchanger fins and for initiating a defrost cycle in response thereto comprising:

means at a first peripheral location of said heat exchanger for generating a detection signal having a characteristic with varies in direct response to build-up of frost on any one of a plurality of portions of the planar surfaces of said adjacent parallel fins of the heat exchanger and directing said signal along and through said plurality of portions of said heat exchanger along a direct path which passes through the central portion of the heat exchanger between adjacent parallel fins, said path being oriented in a plane generally parallel to said adjacent parallel fins, said detection signal;

means at the end of said path, and at a second peripheral location of said heat exchanger opposed from said first peripheral location for sensing said variation in said detection signal characteristic and for producing a control signal in response to said characteristic achieving a selected value;

means normally responsive to the control signal for discontinuing cooling operation of the cooling system and for initiating a defrost cycle; and means operative in response to failure of said detection signal generating means for precluding discontinuance of said cooling operation and initiation of said defrost cycle.

27. The cooling system of claim 26 wherein said failure responsive means is operative to preclude energization of control signal responsive means in response to failure of said detection signal generating means.

28. The cooling system of claim 26 including alarm means responsive to failure of said detection signal generating means for producing an alarm.

29. The cooling system of claim 26 including manually operative means for discontinuing cooling operation of the cooling system and for initiating said defrost cycle independently of the failure of said detection signal override means.

30. The demand defrost system of claim 26 wherein said defrost cycle initiating means sustains said defrost cycle independently of subsequent termination of said control signal.

31. The demand defrost system of claim 26 including temperature sensing means actuated in response to a selected temperature condition indicating that defrosting is complete and;

defrost cycle termination means operable to terminate said defrost cycle and initiate the cooling cycle in response to actuation of said temperature sensing means.

32. The demand defrost system of claim 31 including safety means for energizing said defrost cycle termination means upon failure of said temperature sensing means.

33. The demand defrost system of claim 32 wherein said safety means includes high temperature sensing means actuated in response to a second temperature condition higher than said selected temperature condition, said defrost cycle termination means being operated in response to actuation of said high temperature safety means.

34. The demand defrost system of claim 32 wherein said safety means includes timing means energized in response to initiation of said defrost cycle and de-energized upon termination of said defrost cycle;

said timing means operative after a selected time interval to effect energization of said defrost cycle termination means, said time interval being longer than the time interval when said temperature sensing means would normally be actuated, whereby said timing means is operative upon failure of said temperature sensing means.

* * * * *